US008961223B2

(12) United States Patent
Daughtry, Jr. et al.

(10) Patent No.: US 8,961,223 B2
(45) Date of Patent: Feb. 24, 2015

(54) F-CONNECTOR WITH CHAMFERED LOCK RING

(75) Inventors: Earl Anthony Daughtry, Jr., Lawrenceville, GA (US); Ronald Hodge, Flowery Branch, GA (US); Shuojun (Tony) Duan, CiXi (CN)

(73) Assignee: Genesis Technology USA, Inc., Norcross, GA (US)

( * ) Notice: Subject to any disclaimer, the term of this patent is extended or adjusted under 35 U.S.C. 154(b) by 224 days.

(21) Appl. No.: 13/598,015

(22) Filed: Aug. 29, 2012

(65) Prior Publication Data

US 2014/0065879 A1 Mar. 6, 2014

(51) Int. Cl.
*H01R 9/05* (2006.01)

(52) U.S. Cl.
USPC ..... 439/578

(58) Field of Classification Search
CPC .... H01R 2103/00; H01R 9/05; H01R 13/622; H01R 24/564; H01R 9/0521; H01R 43/20; H01R 13/025; H01R 13/5202; H01R 24/40; H01R 24/54
USPC ..... 439/578–583
See application file for complete search history.

(56) References Cited

U.S. PATENT DOCUMENTS

| | | | | |
|---|---|---|---|---|
| 2,782,301 | A * | 2/1957 | Peterson | 439/683 |
| 3,293,592 | A | 12/1966 | Blonder | |
| 3,364,457 | A * | 1/1968 | Veith et al. | 439/581 |
| 4,897,045 | A | 1/1990 | Dyck | |
| 5,194,022 | A | 3/1993 | Enomoto | |
| 5,658,171 | A * | 8/1997 | Pauza et al. | 439/675 |
| 5,667,409 | A | 9/1997 | Wong et al. | |
| 5,863,226 | A | 1/1999 | Lan et al. | |
| 5,865,654 | A | 2/1999 | Shimirak et al. | |
| 6,019,622 | A | 2/2000 | Takahashi et al. | |
| 6,089,903 | A * | 7/2000 | Stafford Gray et al. | 439/578 |
| 6,254,399 | B1 | 7/2001 | Huang | |
| 6,299,479 | B1 | 10/2001 | Tang | |
| 6,450,836 | B1 | 9/2002 | Youtsey | |
| 6,899,563 | B1 | 5/2005 | Lee | |
| 7,479,035 | B2 | 1/2009 | Bence et al. | |
| 7,896,695 | B1 | 3/2011 | Huang | |
| 8,298,020 | B1 | 10/2012 | Chen | |

(Continued)

FOREIGN PATENT DOCUMENTS

WO WO 2013025246 2/2013

OTHER PUBLICATIONS

U.S. Official Action dated Oct. 25, 2013 in U.S. Appl. No. 13/208,786, filed Aug. 12, 2011, First Named Inventor: Vallely.

(Continued)

*Primary Examiner* — Briggitte R Hammond
(74) *Attorney, Agent, or Firm* — Lee & Hayes, PLLC; Charles L. Warner

(57) ABSTRACT

An F-connector for a coaxial cable has a substantially flush, coplanar face comprising a first insulator, locking ring, and connector body with a swaged leading edge. Within the connector body a connecting lead is attached to and spans between the first insulator and a second insulator. The F-connector may be constructed by a process that permits front-loading of the connecting lead and insulators, or by a process that permits back-loading of the connecting lead and insulators, or by a process that permits partial back-loading and partial front-loading of the connecting lead and insulators.

7 Claims, 6 Drawing Sheets

(56) References Cited

U.S. PATENT DOCUMENTS

| | | | | |
|---|---|---|---|---|
| 8,419,468 | B2 * | 4/2013 | Alrutz et al. | 439/578 |
| 2012/0190247 | A1 | 7/2012 | Daughtry et al. | |

OTHER PUBLICATIONS

U.S. Official Action dated May 23, 2013 in U.S. Appl. No. 13/208,786, filed Aug. 12, 2011, First Named Inventor: Vallely.

U.S. Appl. No. 13/208,786, filed Aug. 12, 2011 entitled "U-Channel Coaxial F-Connector", First named inventor: Vallely.

U.S. Official Action dated Aug. 28, 2012 in U.S. Appl. No. 13/208,786.

International Search Report dated May 2, 2012 in PCT/US2012/020079.

U.S. Official Action dated Dec. 31, 2012 in U.S. Appl. No. 13/208,786.

* cited by examiner

F-CONNECTOR WITH CHAMFERED LOCK RING

BACKGROUND

Electronic assemblies generally require connectors for input and output of power and signals. For example, radio frequency (RF) connectors such as coaxial connectors are often used in applications for radio communications, cable television, data communications, test/measurement, and various other systems. The quality and durability of the interface formed between an RF connector and a can, shield, or other housing into which the connector is mounted can have implications both mechanical and electromagnetic. Because a connector is the point of interface for cables or other assemblies attached by an end user, the connector can be a focus of mechanical stress due to movement, over-tightening, or other wear and abuse.

A common embodiment of coaxial cable comprises a center conductor (usually a solid copper wire) surrounded by an insulating layer that is enclosed by a shield layer, typically a woven metallic braid. Finally, an outer insulating jacket provides protection. Normally, the shield is kept at ground potential and a voltage is applied to the center conductor (with respect to ground) to carry the electrical signals. Over the lifetime of the coaxial cable connector, it is expected that the coaxial cable will be connected/disconnected as the equipment it is connected to is installed, moved, replaced, etc.

It is with respect to these considerations and others that the disclosure made herein is presented.

SUMMARY

Concepts and technologies are described herein for coaxial connectors which incorporate a substantially flush and coplanar face that may be assembled using a front-load process, a rear-load process, or a combined front-load and rear-load process.

In one embodiment, a coaxial connector includes a substantially flush and coplanar face comprised of a first or front insulator, a locking ring mounted on the first insulator, and a leading edge of the connector body that is swaged over the locking ring. Such an embodiment includes a substantially flush and coplanar face comprised of the insulator, the locking ring, and the swaged leading edge of the connector body.

In one embodiment, a coaxial connector includes a plurality of substantially flush and coplanar faces. Each face comprises an insulator and a leading edge of the connector body that is swaged over the insulator. Such an embodiment includes at least one substantially flush and coplanar face comprised of the insulator, the locking ring, and the leading edge of the connector body.

In one embodiment, a coaxial connector includes a body with a first interior width and a second interior width, and an open end with a leading edge. A first insulator is at least partially positioned within the first interior width, which is adjacent to the leading edge. A second insulator is at least partially positioned within the second interior width. A connecting lead is attached at one end to the first insulator and at another end to the second insulator. A locking ring is mounted over the front side of an insulator. Such an embodiment includes at least one substantially flush and coplanar face comprised of an insulator, the locking ring, and the leading edge of the connector body. In another embodiment, the body includes a third interior width that is less than the first interior width and greater than the second interior width.

In one embodiment a method of assembling a F-connector by front-loading includes providing a connector body that comprises a leading edge at an open front end and a substantially closed back end; affixing a first insulator to a connector lead; affixing a second insulator to the connector lead; inserting the first insulator, second insulator, and a portion of the connector lead inside the connector body through the open front end; mounting a locking ring on the first insulator; and swaging the leading edge to form a face comprising the first insulator and the leading edge. Such an embodiment includes at least one substantially flush and coplanar face comprised of an insulator, the locking ring, and the leading edge of the connector body.

In another embodiment a method of assembling a F-connector by rear-loading includes providing a connector body that comprises a leading edge at an open front end and an open back end; affixing a first and second insulator to a connector lead; inserting the insulators and a portion of the connector lead inside the connector body through the back end; affixing a locking ring at the back end, mounting a locking ring on the front insulator; and swaging the leading edge to form a face comprising an insulator, locking ring and the leading edge. Such an embodiment includes at least one substantially flush and coplanar face comprised of the first insulator, the locking ring, and the leading edge of the connector body.

In another embodiment a method of assembling a F-connector by partially front-loading and partially rear-loading, includes providing a connector body that comprises a leading edge at an open front end and an open back end; affixing a back insulator to a connector lead; inserting the back insulator and a portion of the connector lead inside the connector body through the open back end; affixing a locking ring at the open back end; affixing a front insulator at the connector lead through the open front end; mounting a locking ring on the front insulator, and swaging the leading edge to form a face comprising the first insulator, locking ring, and the leading edge. Such an embodiment includes at least one substantially flush and coplanar face comprised of the front insulator, the locking ring, and the leading edge of the connector body.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
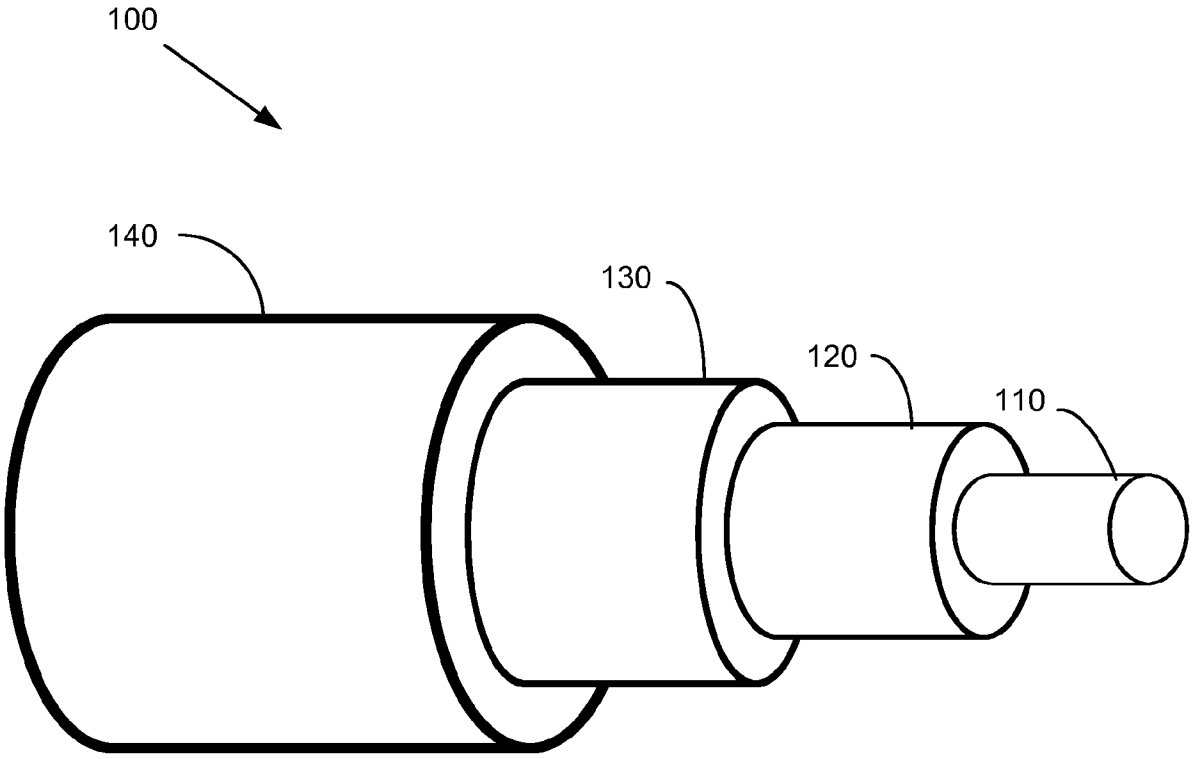
FIG. 1 (prior art)
FIG. 1 is a prior art schematic diagram showing a conventional coaxial cable for use with coaxial connectors as disclosed herein.

The following Detailed Description is directed to cable connectors and methods of constructing cable connectors.

For purposes of description and illustration, and not limitation or restriction, the present teachings are disclosed with reference to coaxial cable connectors. In this Detailed Description references are made to the accompanying drawings, which form a part hereof, and that show by way of illustration various embodiments or examples of the present disclosure. Referring now to the drawings, wherein like numerals represent like elements throughout the several FIGS., aspects of coaxial connectors are presented.

Coaxial cable is frequently used in the delivery of data, including video and voice signals. For example, consumers frequently encounter coaxial cable in conjunction with residential cable television service applications (e.g., set top boxes, television sets, computers, etc.), and industry typically encounters coaxial cable with communication, security, and computer networks (e.g., WANs, LANs, panel boxes, control panels, etc.)

One example of a coaxial cable is the prior art diagram shown in FIG. 1. In FIG. 1, the coaxial cable 100 comprises a center conductor 110, which is usually a copper wire. A dielectric insulator 120 surrounds the center conductor 110, and is typically made of foam or plastic. The dielectric insulator 120 is surrounded by a shield 130, which prevents RF energy from radiating outside the coaxial cable 100. Finally, an insulating jacket 140 is used to protect the coaxial cable 100, which may be exposed to harsh weather and other abusive conditions.

There are various types of coaxial cable 100, including types referred to as "RG-6" and "RG-59" used in connecting television equipment. For example, with RG-6 coaxial cable the center conductor 110 comprises 18 AWG wire, which is about 0.0403" or 1.024 mm in diameter. "RG-58" is used in data communications for local area networks, and other types for other applications. The coaxial cable 100 exhibits impedance and for RG-6 and RG-59 type coaxial cable used for delivery of video signals, the impedance is nominally 75 Ohms. It is necessary to terminate a coaxial cable 100 in order to connect it to the desired device. By way of illustration and limitation, the coaxial cable 100 is presumed to be connected to a receiving device, such as a television set top box. In order to facilitate interconnection between the coaxial cable and receiving device, various standards have been developed that define the size and characteristics of the connector.

One common connector used for connecting coaxial cable 100 to a receiving device is known as a "coaxial F-connector." The coaxial F-connector (also sometimes referred to as "F-connector" herein) typically comprises a male part (not shown) and a female part. The male part typically is attached to the coaxial cable 100, and the female part is typically attached to the receiving device, such as by soldering to a printed circuit board of the receiving device. This disclosure pertains to primarily the female part.

Connectors for various purposes, such as but not limited to splicing cables and connecting cables to receiving devices, vary in structure and configuration. The structure and configuration is typically merely a design choice. Some structural characteristics of connectors, including F-connectors, may be desirable, such as a substantially symmetrical body, ease of manufacture, and ease of assembly.

Figure 2:
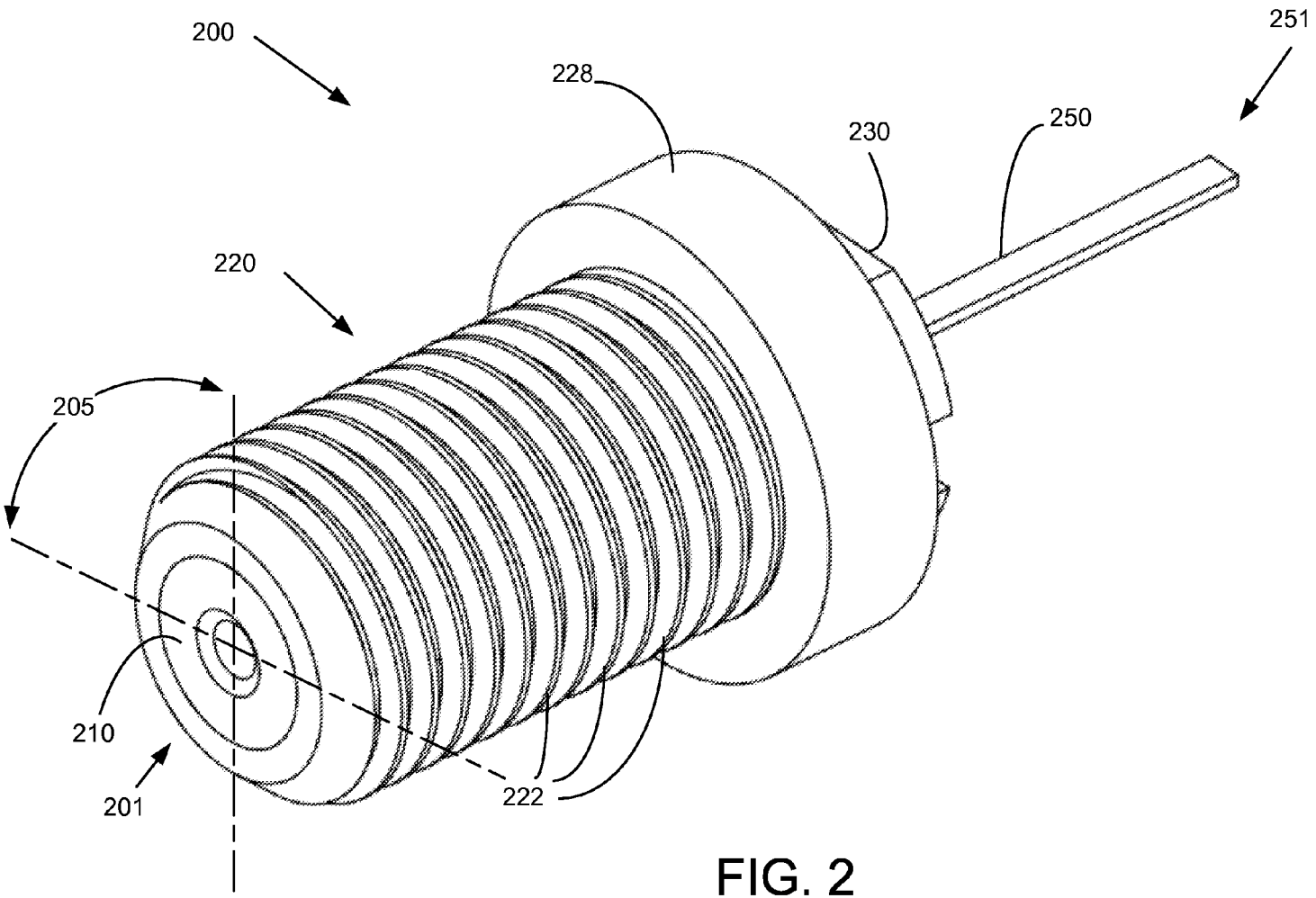
FIG. 2 is a perspective diagram showing one embodiment of a coaxial F-connector as disclosed herein.

Turning now to FIG. 2, there is shown a perspective view of one embodiment of an F-connector 200. In this illustration the external components are readily discernible while the internal components are more readily discernible in FIG. 3. For the purposes of orientating, teaching, and describing the present disclosure, and not by way of limitation or restriction, reference is made to the "front" and to the "back" of the F-connector 200. The F-connector front end 201 is the end associated with the F-connector face 205. The F-connector face 205 is a substantially flush, coplanar surface comprising a plurality of components, as described in further detail below. The "back" of the illustrated F-connector 200 is the back end 251, opposite the F-connector front end 201. As will become evident, many of the F-connector components can be described as having a front end or back end, but that orientation reference merely refers to the side that is facing the front end 201 or the back end 251, respectively, even though the component itself may be located primarily at the front or back of the F-connector 200.

Located at the front end 201 is a first or front insulator 210. A front insulator 210 typically comprises a dielectric plastic with insulating qualities, and ensures that the center conductor 110 of the coaxial cable 100 does not contact other portions of the F-connector 200, namely the connector body 220. Insulators may be made of various dielectric materials, including polymers, ceramics, porcelains, glass, combinations thereof, and the like.

The connector body 220 typically comprises a symmetric and cylindrical metal body defining a longitudinal axis (best shown in FIGS. 4A-4B), including a series of threads 222 that mate with the male connector. In the illustrated embodiment, the F-connector 200 includes a ⅜-32 UNEF-2A thread. The reference to "threads" herein recognizes that this structure can also be described in the singular form—e.g., a single continuous "thread." The F-connector body 220 also typically comprises a collar portion 228 and an indexing key 230, which may aid in positioning the F-connector 200 into a mounting aperture of the receiving device or a printed circuit board.

The F-connector body 220 is typically connected to an electrical ground in the receiving device and to the shielding of the coaxial cable. Extending from the connector body 220 is a connecting lead 250. Typically, the connecting lead 250 is connected from the back end 251 to a printed circuit board, such as by soldering. Also, as best illustrated with temporary reference to FIGS. 4A-4B, the connecting lead 250 runs inside the length of the F-connector body 220, engaging the center conductor 110 of the coaxial cable 100 when the male connector is mated to the F-connector 200. In this way the signal from the coaxial cable 100 is transmitted to the receiving device.

The illustrated F-connector body 220 is machined from a stock of stainless steel, threaded from the front end 201 to the collar portion 228, and followed by the indexing key 230 at the back end 251. Alternative embodiments of connectors according to the present disclosure, including F-connectors, comprise: a connector body that is asymmetrical and not cylindrical; a connector body that is threaded substantially its entire length; a connector body that is not threaded substantially its entire length; a connector body that includes a plurality of collars; a connector body that does not include an indexing key; a connector body that is cast rather than machined; a connector body that includes a face at both the front end and the back end; a connector body that includes three or more faces; a connector body manufactured of various materials including metals, polymers, ceramics, porcelains; and a connector body comprising combinations thereof, and the like.

Figure 3:
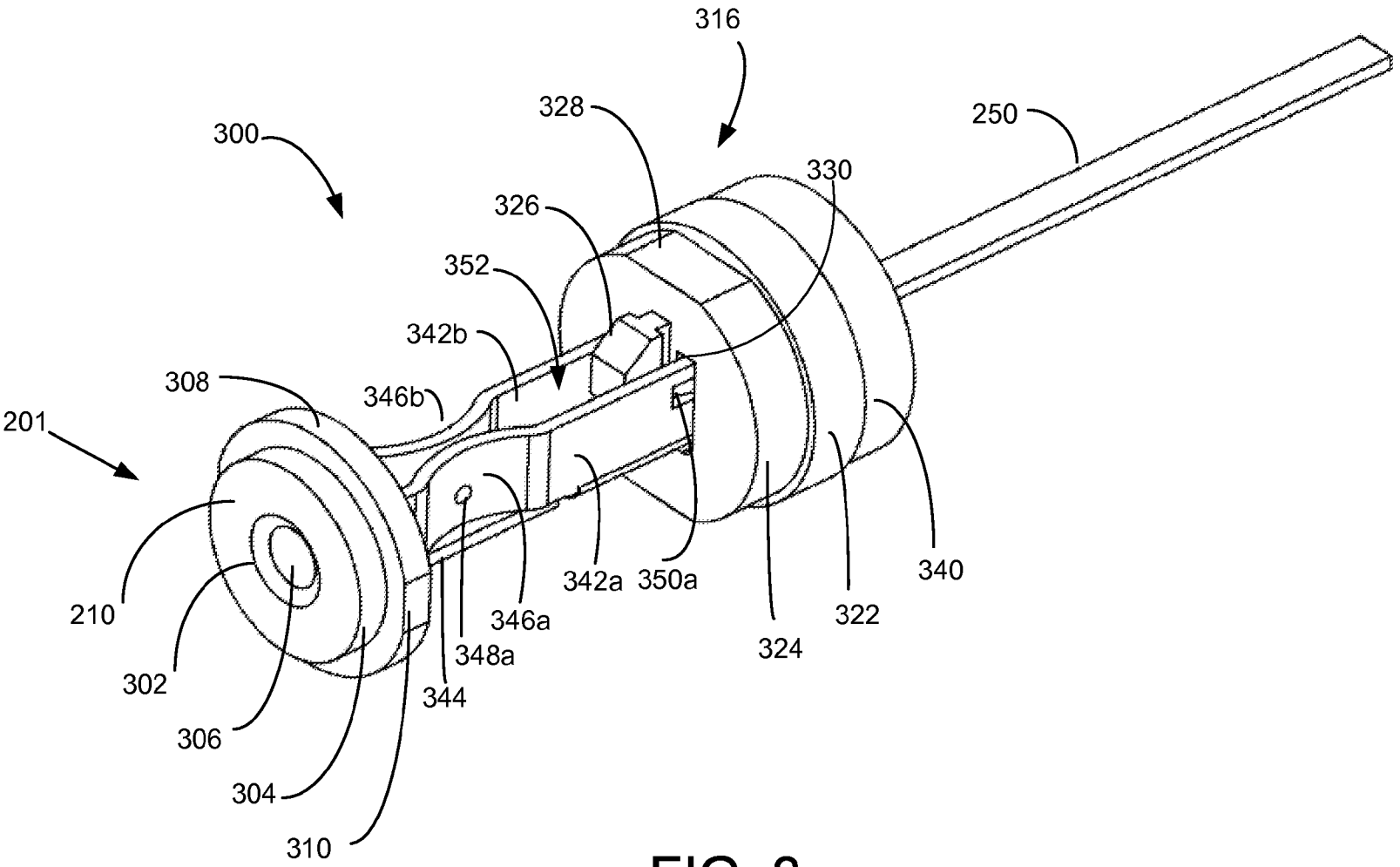
FIG. 3 is a perspective diagram showing one embodiment of components of a coaxial F-connector as disclosed herein.

With reference now to FIG. 3, there is shown a perspective view of an embodiment of a subassembly 300 for an F-connector 200. In this illustration the internal components are readily discernible while the external components are more readily discernible in FIG. 2. Turning first to the front end 201, the front insulator 210 is seen affixed to the front of the connecting lead 250.

The front insulator 210 is configured to include a conductor receiving aperture 306 to receive the center conductor 110. The conductor receiving aperture 306 ensures that the center conductor 110 does not electrically contact with the connector body 220. The center conductor 110 contacting the connector body 220 would likely short out the signal carried by the center conductor 110. Thus, there should be no direct electrical contact between any part of the connector body 220 and any part of the connecting lead 250. Around the edge of the conductor receiving aperture 306 is a chamfer 302 or bevel, to aid in guiding and receiving the center conductor 110 into the F-connector 200. The front insulator 210 further includes a perimeter groove 304 (onto which is mounted a front locking ring, best shown in FIGS. 4A-4B). Adjacent to the perimeter groove 304 is a side surface 308, which is designed to contact the connector body 220. A front insulator indexing surface 310 aids in ensuring the proper rotational positioning of the front insulator 210 within the connector body 220.

The second or back insulator 316 is seen affixed to a center portion of the connecting lead 250. The back insulator 316 comprises a collar portion 322 that contacts the inside of the connector body 220 and functions to position and hold the back insulator 316 within the connector body 220. In some embodiments the back insulator 316 also comprises a front shoulder portion 324 in front of the collar portion 322. In some embodiments, such as illustrated here, the front shoulder portion 324 is of a smaller width relative to the collar portion 322. In alternative embodiments the front shoulder portion 324 is the same width, or a larger width, or is absent from the back insulator 316.

In some embodiments, such as illustrated here, the back insulator 316 also comprises a key 326, which engages with the connecting lead 250, and an indexing surface 328 for rotational positioning of the back insulator 316 within the connector body 220. In other embodiments one or both of the key 326 and indexing surface 328 are absent. The back insulator 316 also comprises a receiving aperture 330 through which the connecting lead 250 is inserted to be positioned and held. The illustrated receiving aperture 330 is U-shaped, to reflect that portion of the connecting lead 250 that is held by the receiving aperture 330. In other embodiments the receiving aperture 330 is a different configuration, to reflect the shape of the respective connecting lead 250.

Figure 4A:
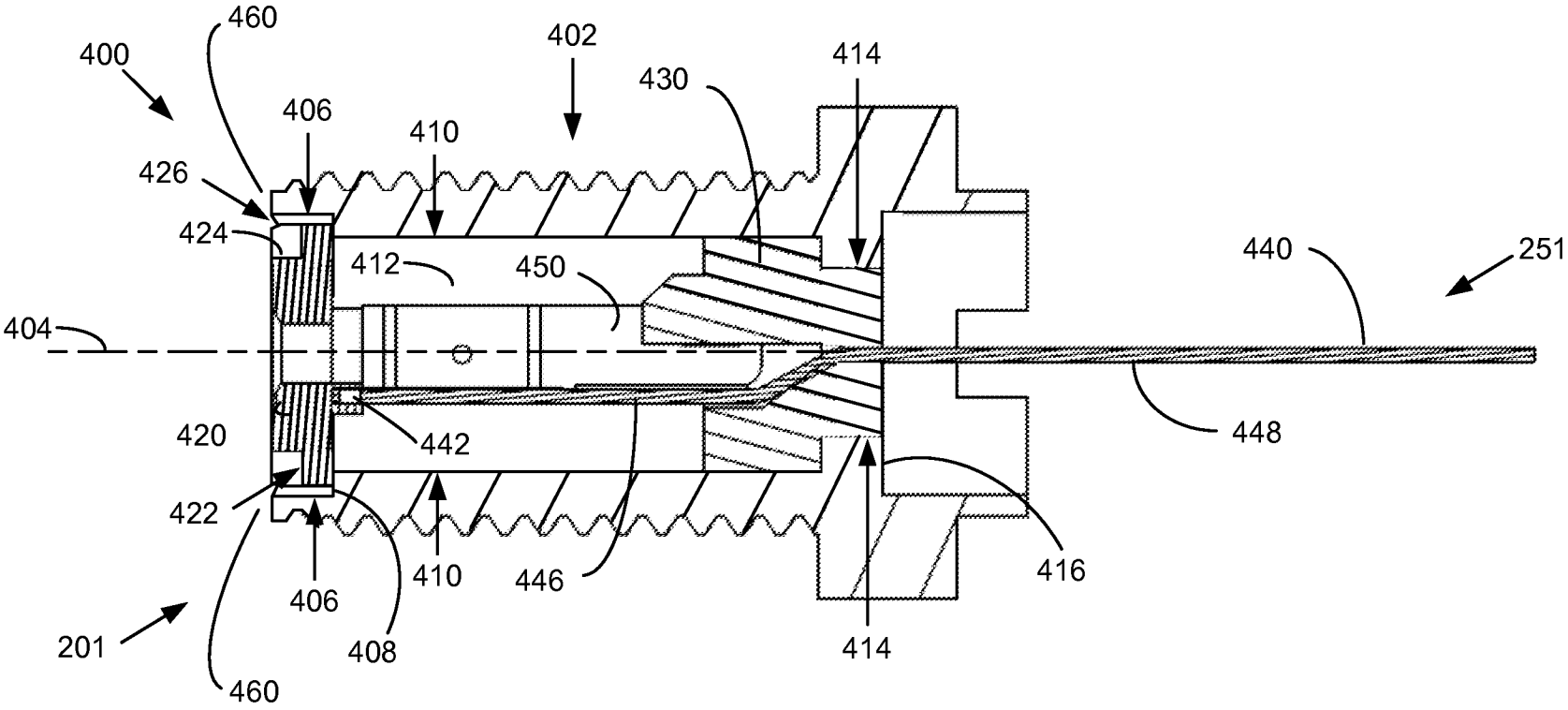
FIGS. 4A and 4B are cross-sectional diagrams of one embodiment of a coaxial F-connector as disclosed herein.
Figure 4B:
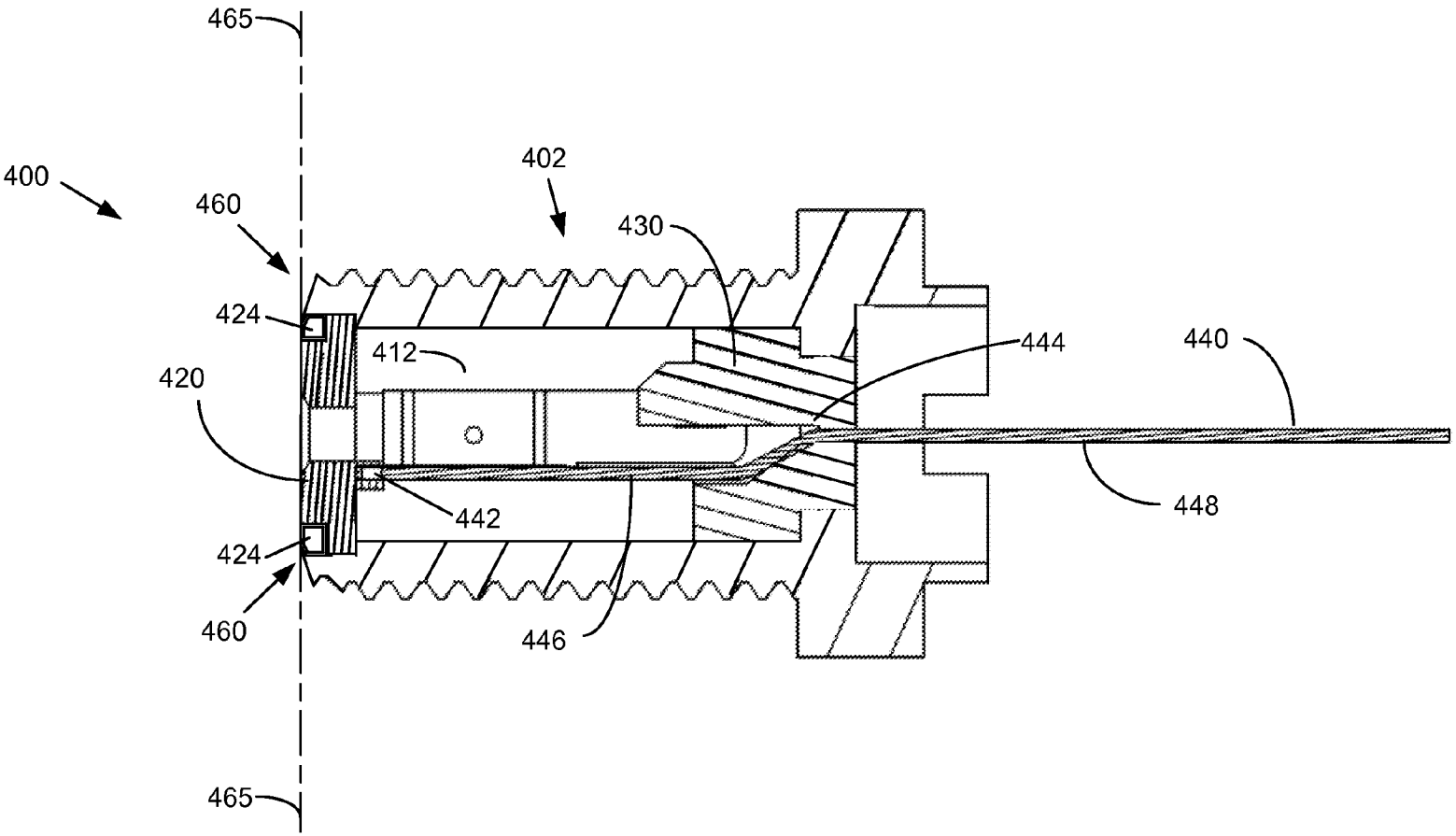

In addition, in the illustrated embodiment is a rear locking ring 340 shown behind the back insulator 316. The rear locking ring 340 is a separate component from the back insulator 316, and for some embodiments is positioned to hold the subassembly 300 within the connector body 220. In alternative embodiments (such as shown in FIGS. 4A-4B and described below) an interior shoulder holds the back insulator 316 and entire subassembly 300 within the connector body 220.

The illustrated connecting lead 250 comprises two side wall portions 342*a* and 342*b* (collectively referred to as 342). Each side wall 342 is bent perpendicular to a center portion, which is the bottom portion 344 of the connecting lead 250. Each side wall 342 has, in this embodiment, a curved contact portion 346*a* and 346*b* (collectively referred to as 346). The curved contact portions 346 are formed with a curvature and are configured to contact the center conductor 110. In one embodiment, a side wall aperture 348*a* is formed in the side wall 342*a*. A corresponding aperture in the other sidewall is present (not shown). In other embodiments, the aperture 348*a* is not present in the side wall 342*a*. In other embodiments, a bent, instead of curved contact portion, may be present. In one embodiment, the thickness of the connecting lead 250 may be 0.014"; the width of the connecting lead 250 may be 0.080"; the length of the side wall 342 may be 0.450"; and the gap between the side walls may be 0.004". Other embodiments may use other values.

Each side wall 342 also has a locking tab 350 formed therein. More specifically, each side wall 342 has a locking tab 350 configured to protrude so as to grip on the side of the key 326. When the connecting lead 250 is inserted into the back insulator 316 during assembly, the locking tabs 350 hold the key 326 so that the two components are attached. The configuration of the side walls 342 and the bottom portion 344 form a channel 352. The channel 352 has a "U" shape, with the sides of the channel 352 formed by side walls 342. Each side wall 342 is of equal and constant height in the illustrated embodiment. The width of the channel 352 at any given point, can vary based on the shape of the sidewall 342.

In other embodiments the connecting lead 250 may be of any structure and configuration. For example, a connecting lead 250 that connects to a center conductor 110 at the front end 201 and another center conductor 110 at the back end 251 in order to transmit a signal from one cable to another; or a connecting lead 250 that connects two center conductors 110 at two front ends 201 and a receiving device at the back end 251. These connecting lead 250 embodiments make take various shapes, including channels, flanges, cylindrical conduits or tubes, arched conduits, angled walls, combinations thereof, and the like.

FIG. 4A is a cross-sectional side view of an embodiment of a partially assembled F-connector 400, showing both the external components and subassembly 300. The illustrated connector body 402 is cylindrical and symmetric, defining a longitudinal axis 404 and three interior widths. The first interior width 406 defines a front shoulder 408, the second interior width 410 defines a center chamber 412, and the third interior width 414 defines a rear shoulder 416. In some embodiments the center chamber 412 includes a flattened inner wall (not shown) that forms an indexing surface, which matingly interfaces with a component of the subassembly 300, such as the insulator indexing surfaces 310, 328.

A first or front insulator 420 is shown as positioned inside the first interior width 406 and mating with the front shoulder 408. The front insulator 420 includes a perimeter groove 422, which receives a front locking ring 424. The front locking ring 424 includes a chamfer or perimeter bevel 426. A second or back insulator 430 is shown as positioned inside the third interior width 414 and mating with the rear shoulder 416. A connecting lead 440 is engaged to and held at its front end by a front insulator mount 442. At a distance spaced apart from its front end the connecting lead 440 is engaged to and held by the back insulator aperture 444.

As described in greater detail below, in an F-connector 400 assembled according to FIGS. 4A-4B a lock ring 424 is pressed into position within the perimeter groove 422 and secured. Thus the subassembly 300 is engaged within the connector body 402 body and cannot move vertically, horizontally or laterally. Accordingly, the connecting lead 440 is prevented from moving vertically, laterally or horizontally, with respect to its orientation to the longitudinal axis 404, by the front insulator 420 and back insulator 430. Lateral movement is hindered by the stepped shoulder 408, where the insulator 420 is capable of withstanding high front forces along axis 404.

FIG. 4A also illustrates that the connecting lead 440 comprises a single piece of metal that has a center portion 446 located inside the center chamber 412 and a rear portion 448 located outside the connector body 402. The symmetric and adjacent sidewalls 450*a*, 450*b* (not visible) of the connecting lead 440 receivingly engage the center conductor 110.

In the illustrated embodiment the back insulator 430 matingly engages with the rear portion 448, and ensures that there is no contact between the connecting lead 440 and the connector body 402. Both the back insulator 430 and the front insulator 420 are typically made of dielectric material with a specific dielectric constant. In one embodiment, the dielectric constant is 3.2. The connecting lead 440 passes through the back insulator 430 and is attached to a receiving device (not shown), such as by soldering to a circuit board. In this manner, the signals from the center conductor 110 are passed to the receiving device.

FIG. 4B is likewise a cross-sectional side view of an embodiment of a fully assembled F-connector 400. The operations of assembly are described with regard to FIG. 5. Meanwhile, here, the illustrated subassembly 300 is positioned within the connector body 402 with the front locking ring 424 mounted onto the perimeter groove 422. The leading edge 460 of the connector body 402 is then swaged inwardly, into the chamfer or perimeter bevel 426, to secure the front locking ring 424. As used herein, the term "swage" and all its derivatives, whether in the singular or plural including "swaged" and "swaging", is used expansively to include all manner of folding, bending, pressing, forming, shaping, forging, working, or molding, combinations thereof and the like, the leading edge 460 to create the face 465.

With the swaging of the leading edge 460 into the chamfer or perimeter bevel 426, the subassembly 300 is secured within the connector body 402. Also, with the swaging of the leading edge 460 onto the chamfer or perimeter bevel 426 there is created a face 465, which is a substantially flush and coplanar surface comprised of the leading edge 460, the lock ring 424, and the front insulator 420.

Figure 5:
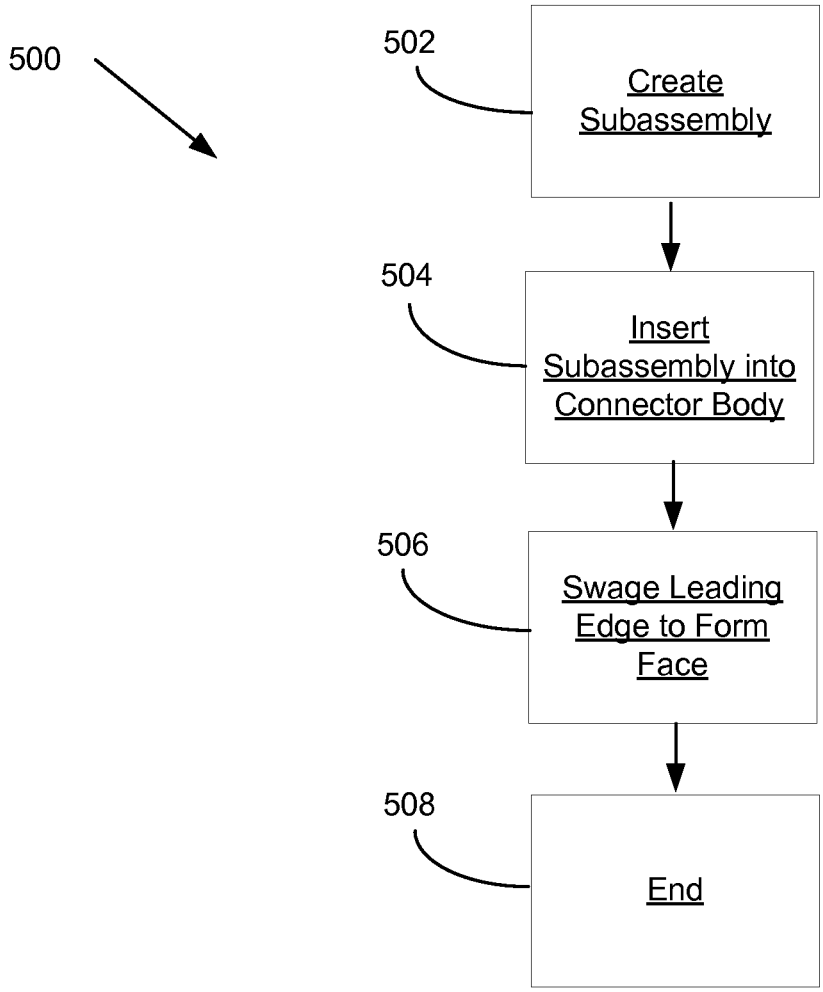
FIG. 5 illustrates a process flow for assembling an embodiment of a coaxial F-connector as disclosed herein.

Turning now to FIG. 5, processes for assembling a connector according to the present disclosure is described. The process 500 presumes that the various components are already formed, such as but not limited to: the connecting lead 250, 440; first or front insulator 210, 420; second or back insulator 316, 430; rear locking ring 340; front locking ring 424; and connector body 220, 402. In alternative embodiments, a connector may comprise more or less components, all of which are likewise presumed to already be formed.

In operation 502 there is created a subassembly 300 wherein the connecting lead 250, 440 is inserted into the back insulator 316, 430 and positioned so that the locking tabs 350 engage the key 326. The connecting lead 250, 440 is also attached to the front insulator 210, 410, by engaging the connecting lead 250, 440 front end with the front insulator mount 442.

In operation 504, the subassembly 300 created in operation 502 is inserted into the connector body 220, 402. In one embodiment the subassembly 300 is inserted into the connector body 220, 402 from the front end 201. In a front-loaded embodiment the subassembly 300 is inserted with the back insulator 316, 430 leading and the front insulator 210, 410 trailing, until the back insulator 316, 430 matingly engages and nests with the rear shoulder 416. This engagement may create a friction fit that partially secures the subassembly 300 in the connector body 220, 402. In alternative embodiments other structural elements within the connector body 220, 402 may matingly engage or otherwise stop the back insulator 316, 430 so that the subassembly 300 cannot be further inserted into the connector body 220, 402. With operation 504 the subassembly 300 is inserted into the connector body 220, 402.

In operation 506 the front locking ring 424 is pressed into the perimeter groove 422 and the leading edge 460 is swaged to secure the front locking ring 424 along the chamfer or perimeter bevel 426. In alternative embodiments the front locking ring 424 is absent and the leading edge 460 is swaged to secure the perimeter of the front insulator 210, 420. With operation 506 there is created the face 205, a substantially flush and coplanar surface, comprising at least the front insulator 210, 420 and leading edge 460. In addition, with operation 506, the subassembly 300 is secured in the connector body 220, 402. With operation 508 the process ends.

In alternative embodiments, the subassembly 300 created in operation 502 is inserted into the connector body 220, 402 from the back end 251. In a rear-loaded embodiment the subassembly 300 is inserted with the front insulator 210, 420 leading and the back insulator 316, 430 trailing, until the back insulator 316, 430 matingly engages and nests with the rear shoulder 416. In that embodiment the rear shoulder 416 faces the back end 251 instead of the front end 201, as illustrated in FIGS. 4A-4B, and the interior widths 406, 410, 414 are large enough to allow the front insulator 210, 420 to pass through the connector body 220, 402. The back insulator 316, 430 matingly engages and nests with the rear shoulder 416 so that the subassembly 300 cannot be further inserted into the connector body 220, 402. The leading edge 460 is swaged to secure the front locking ring 424 or front insulator 210, 420 around its perimeter. In these alternative embodiments there is also created the face 205, a substantially flush and coplanar surface.

In a combined front-load and rear-load embodiment, a subassembly comprising only the connecting lead 250, 440 engaged to the back insulator 316, 430 is inserted from the back end 251, with the connecting lead 250, 440 front end leading and the back insulator 316, 430 trailing. The front insulator 210, 420 is attached to the connecting lead 250, 440 from the front end 201. The leading edge 460 is swaged to secure the front locking ring 424 or front insulator 210, 420 to create the face 205. In some embodiments, such as the rear-load embodiments, the rear locking ring 340 is installed to secure the subassembly 300 from the back end 251. In some embodiments the rear locking ring 340 is not required.

In other embodiments, the components may be fitted into each other in different ways or in a different order. For example, in lieu of locking tabs 350, other friction, adhesive, or attaching means known to those skilled in the may be used to affix the connecting lead with the back/front insulators. Further, the connecting lead 250 could be heated to weld the insulators to the connecting lead, or the insulators could be injection molded around the connecting lead. Those skilled in art may develop other variations for assembling or forming the components, such as forming a one-piece combination front and back insulator, into which the connecting lead may be inserted or positioned.

Based on the foregoing, it should be appreciated that a connector is disclosed for coaxial cable. It should also be appreciated that the subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

The invention claimed is:

1. An apparatus, comprising:

a connector body, comprising:

a first interior width, a second interior width, a swaged leading edge;

a subassembly, comprising:

a first insulator positioned at least partially within the first interior width, a second insulator positioned at least partially within the second interior width, a connecting lead with a plurality of ends, attached at a first end to the first insulator and attached at a second end to the second insulator; and, a substantially flush coplanar face, comprising the first insulator and swaged leading edge.

2. The apparatus of claim 1, wherein the first insulator includes a perimeter configured to attach to a locking ring.

3. The apparatus of claim 2, wherein the face further comprises the locking ring.

4. The apparatus of claim 1, wherein the first interior width is greater than the second interior width.

5. The apparatus of claim 4, further comprising a third interior width that is less than the first interior width and greater than the second interior width.

6. A method of assembling an F-connector comprising: providing connector body with a first open end having a leading edge, and a second open end; attaching a connecting lead to a first insulator and to a second insulator; inserting the connecting lead and first and second insulators at least partially within the connector body; and swaging the leading edge of the first open end to secure the first insulator and to form a face comprising the leading edge and the first insulator.

7. The method of claim 6, further comprising mounting a locking ring on the first insulator.

* * * * *